US006065650A

United States Patent [19]

Horton et al.

[11] Patent Number: 6,065,650

[45] Date of Patent: May 23, 2000

[54] PLUG DETECTOR BYPASS BREAKER GUARD

[75] Inventors: Joel Richard Horton, Maryville; Robert Link Dearstone, Powell, both of Tenn.

[73] Assignee: Lockheed Martin Energy Systems, Inc., Oak Ridge, Tenn.

[21] Appl. No.: 08/941,591

[22] Filed: Sep. 30, 1997

[51] Int. Cl.[7] ..... G01F 11/20; B67D 5/08; B01F 15/02

[52] U.S. Cl. ..... 222/196; 222/1; 222/63; 366/184

[58] Field of Search ..... 222/196, 198, 222/199, 200–236, 238–241, 52, 63; 366/184, 194–196

[56] References Cited

U.S. PATENT DOCUMENTS

| | | | |
|---|---|---|---|
| 763,033 | 6/1904 | Wolfe | 222/198 X |
| 1,862,666 | 6/1932 | Duncan | 222/241 |
| 3,081,505 | 3/1963 | Butzow | 222/196 X |
| 3,280,764 | 10/1966 | Potter et al. | 366/195 X |
| 3,429,267 | 2/1969 | Zinga | 222/240 X |
| 4,083,475 | 4/1978 | Venner et al. | 222/198 |
| 4,522,500 | 6/1985 | Hyer | 222/198 |
| 5,113,917 | 5/1992 | McGregor | 222/196 X |
| 5,339,998 | 8/1994 | Warren | 222/241 |
| 5,516,009 | 5/1996 | Kautz | 222/238 |
| 5,533,650 | 7/1996 | Conrad et al. | 222/198 X |

*Primary Examiner*—Kevin Shaver
*Assistant Examiner*—Keats Quinalty
*Attorney, Agent, or Firm*—Nexsen Pruet Jacobs & Pollard, LLP

[57] ABSTRACT

A method and apparatus wherein the apparatus is a container having an inner chamber, an inlet, an outlet, a breaker assembly having at least one blade within the inner chamber of the container and a motor for driving the blade. Material is supplied to the inner chamber of the container through the inlet of the container and the breaker assembly is operated to reduce any clumped material into unclumped material which is then dispensed from the container through the outlet of the container.

23 Claims, 2 Drawing Sheets

PLUG DETECTOR BYPASS BREAKER GUARD

STATEMENT AS TO RIGHTS TO INVENTIONS MADE UNDER FEDERALLY-SPONSORED RESEARCH AND DEVELOPMENT

The U.S. Government has rights in this invention pursuant to contract number DE-AC05-84OR21400 between the United States Department of Energy and Lockheed Martin Energy Services, Inc.

BACKGROUND OF THE INVENTION

The present invention relates generally to material dispensers. Specifically, the present invention relates to a material dispenser including a breaker assembly that prevents the bridging or clogging of a discharge outlet.

Hoppers are well known for their use as material dispensers and in conveying particulate material. Typically, a hopper is a funnel-shaped housing. The hopper has a large opening, or inlet, at the top for receiving the particulate material; and a smaller opening, or outlet, at the bottom for discharging the particulate material. The force of gravity urges the particulate material from the hopper inlet towards the hopper outlet.

Certain particulate materials are prone to form chunks or clumps. These clumps of particulate material can clog or bridge the outlet of the hopper. The clog can reduce or stop the flow of the particulate material from the hopper outlet. The removal of the clumped particulate material from the hopper can prove costly. The flow of particulate material into the hopper inlet must be stopped, and the particulate material present in the hopper must also be removed to access the clumped material.

Numerous attempts have been made to prevent the formation of chunks or clumps in the hopper which can clog or bridge near the hopper outlet. One such attempt is found in U.S. Pat. No. 4,522,500 to Hyer (hereinafter Hyer). Hyer discloses an agitator assembly mounted on the wall of the hopper. The agitator assembly includes a panel disposed within the hopper wall; and a vibrator attached to the external portion of the hopper wall. Both the panel and the vibrator are secured to the hopper wall using elastomeric bushings. The vibrator actuates the panel.

Another attempt is found in U.S. Pat. No. 5,533,650 to Conrad et al. (hereinafter Conrad). Conrad discloses a hopper having both stationary walls and movable walls. Flexible seams connect the opposed movable walls and the opposed stationary walls. A vibration device moves at least one of the movable walls relative to the other movable wall and the stationary walls.

Another attempt involves the use of high pressure air to break up or remove chunks. Air accumulators are provided along the particulate material flow path. The accumulator is valved to selectively inject high pressure air into the material flow path. When a clog occurs, the valve of an accumulator located in that region is opened. The sudden pressure wave produced by the rapid release of the high pressure air enters the particulate material flow path and dislodges the bridge. If detected early enough, the particulate material flow should return to normal.

The aforementioned attempts and other attempts to prevent the formation of chunks or clumps in the hopper which can clog or bridge near the hopper outlet have numerous drawbacks. For instance, the devices may not be capable of sensing the existence of a clog or bridging condition. The devices also may not break up a clog or bridge once it has formed near the hopper outlet. The devices also may not be capable of continued material dispensing operation once a clog or bridge has formed. The devices may not be able to operate in high temperature environments of cement manufacturing plants and other similar processes. Further, the devices may require extensive modification to the hopper for assembly and use.

Clearly, there is room for improvement in the art.

SUMMARY OF THE INVENTION

Therefore, it is an object of the present invention to provide a hopper capable of breaking up a clog or bridge that has, or is about to form, in the hopper.

It is a further object of the present invention to provide a hopper capable of continued operation even if a clog or bridge forms in the hopper.

It is a further object of the present invention to provide a hopper capable of sensing the existence of a clog or bridging condition in the hopper.

It is a further object of the present invention to provide a hopper capable of operation in high temperature environments of, for example, cement manufacturing plants and other similar processes.

It is a further object of the present invention to provide a hopper with an assembly capable of breaking up a clog or bridge that has, or is about to form, in the hopper.

It is a further object of the present invention to provide a hopper with an assembly that allows continued operation of the hopper despite the formation of a clog or bridge in the hopper.

It is a further object of the present invention to provide a hopper with an assembly capable of sensing the existence of a clog or bridging condition in the hopper.

It is a further object of the present invention to provide a hopper with an assembly capable of operation in high temperature environments of, for example, cement manufacturing plants and other similar processes.

It is a further object of the present invention to provide a hopper with a breaker assembly that does not require extensive modification to the hopper for assembly and/or use.

It is a further object of the present invention to provide a method of breaking up a clog or bridge that has, or is about to form, in a hopper.

It is a further object of the present invention to provide a method of sensing whether a clog or bridge has formed in a hopper.

It is a further object of the present invention to provide a method of breaking up a clog or bridge capable of operation in high temperature environments of, for example, cement manufacturing plants and other similar processes.

These and other objects are achieved in one aspect of the present invention by a breaker assembly for use in a material dispenser. The breaker assembly comprises at least one blade positionable within the material dispenser; and a motor connected to said at least one blade for driving said at least one blade.

These and other objects are achieved in a second aspect of the present invention by an apparatus for dispensing material. The apparatus includes: a container having an exterior wall, an inner chamber, an inlet, and an outlet; at least one blade disposed within the inner chamber of the container; and a motor connected to the blade for driving the blade.

These and other objects are achieved in a third aspect of the present invention by a method of dispensing material.

The method involves providing a container having an inner chamber, an inlet and an outlet; providing a breaker assembly, the breaker assembly having at least one blade within the inner chamber of the container, and a motor for driving the blade; supplying material to the inner chamber through the inlet of the container; operating the breaker assembly to reduce any clumped material into unclumped material; and dispensing the material from the outlet of the container.

BRIEF DESCRIPTION OF THE DRAWINGS

The features of the present invention will become apparent to those skilled in the art to which the present invention relates from reading the following specification with reference to the accompanying drawings in which.

DETAILED DESCRIPTION OF THE PREFERRED EMBODIMENTS

Figure 1:
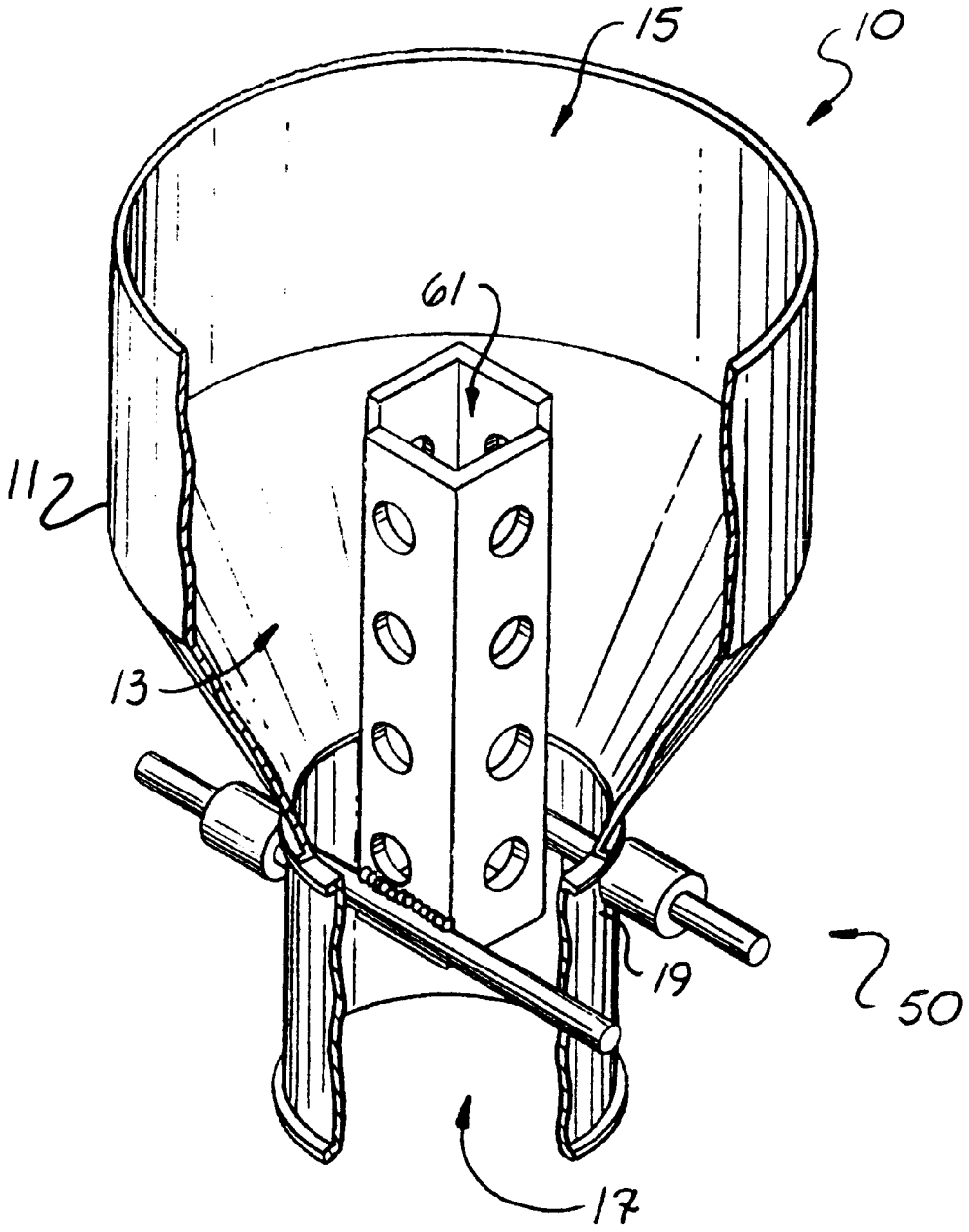
FIG. 1 is a perspective view of a hopper and a breaker assembly of the present invention with a portion of the hopper wall cut away to view breaker assembly in the interior portion of the hopper.
Figure 2:
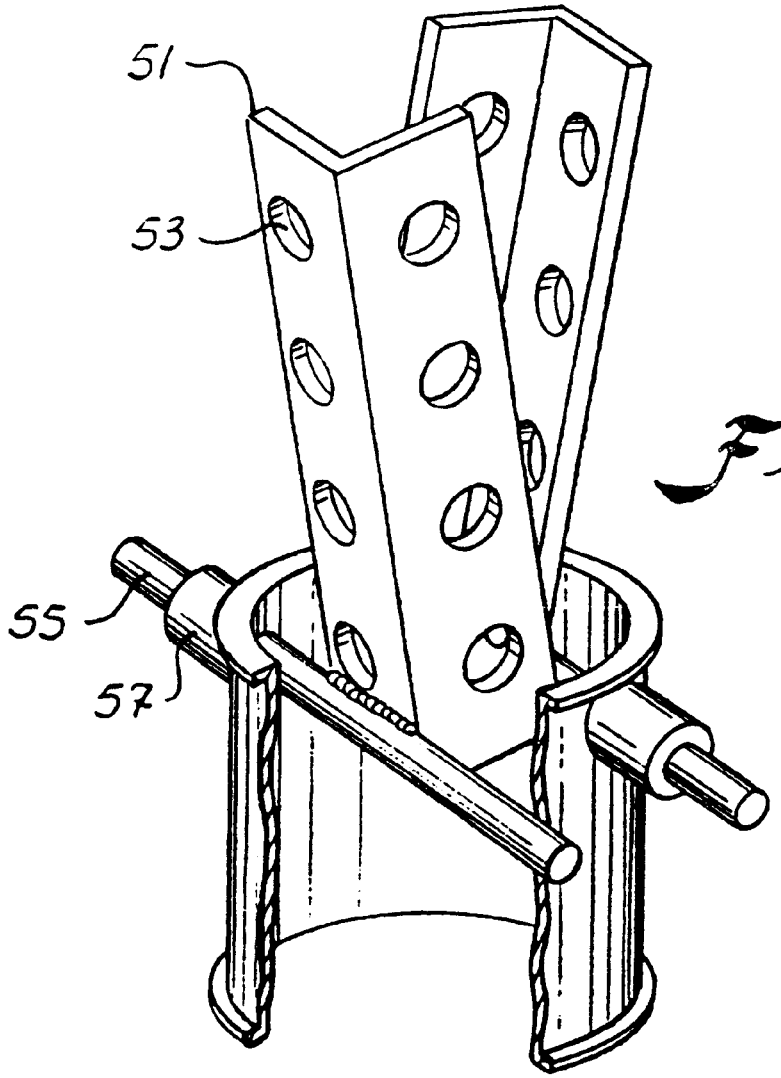
FIG. 2 is a perspective view of the breaker assembly and a portion of the hopper of the present invention.

A preferred embodiment of the present invention will now be described with reference to FIGS. 1–3. FIG. 1 is a perspective view of the present invention, a hopper 10 and a breaker assembly 50. Hopper 10 has an exterior wall 11 that forms an inner chamber 13 that receives particulate material (not shown). Hopper 10 can, for example, be part of a cement manufacturing facility, or other process involving high temperatures. Exterior wall 11 is preferably tapered from an upper end to a lower end to assist in discharging the particulate material (not shown) from hopper 10. However, the present invention does not mandate a specific shape for exterior wall 11. The exterior wall 11 shown in FIG. 1 has a funnel-shaped middle portion flanked by vertical portions at each end of hopper 10. Hopper 10 could alternatively utilize an exterior wall with a constant taper or any other desired shape.

Inner chamber 13 has an upper opening, or inlet, 15 for receiving particulate material (not shown) into hopper 10. Inner chamber 13 also has a lower opening, or outlet, 17 for discharging the particulate material (not shown) from hopper 10. The force of gravity assists in the discharge of the particulate material (not shown) through outlet 17.

The detailed description up to this point describes a typical hopper. Certain types of particulate material that are dispensed in a typical hopper may be prone to form chunks or clumps. When in the upper portion of the typical hopper, the clumps usually do not interfere with the discharge of the particulate material. However, when the clumps of particulate material travel down the typical hopper, particularly near the outlet, the clumps can interfere with the discharge of particulate material. Specifically, the clumps can clog the outlet of the typical hopper entirely, or bridge the outlet and reduce the flow of particulate material exiting the hopper. Removing the clog or bridge can prove costly in typical hoppers. The flow of particulate material into the hopper inlet must be stopped. Then, the particulate material in the hopper must be removed to reach the clumped material.

The present invention utilizes a breaker assembly 50 in hopper 10 to prevent the formation of clogs or bridges near outlet 17. As a result, the flow of particulate material (not shown) from outlet 17 should be unaffected by the presence of chunks or clumps. Breaker assembly 50 will now be described in detail with reference to FIGS. 1–3.

A preferred embodiment of breaker assembly 50 uses at least one blade 51. As shown in the drawings, blade 51 can be L-shaped. However, a blade having any desired shape may be used. Blade 51 may be manufactured from any structural plate material. Blade 51 can include at least one aperture 53 therethrough. The benefit of aperture 53 will be described below.

Blade 51 is connected to a shaft 55, for example, by welding. If hopper 10 is to be retrofitted with breaker assembly 50, then blade 51 can be inserted into a slot (not shown) in shaft 55 and secured to shaft 55 using, for example, a pin or a nut and bolt assembly (not shown) passing through both shaft 55 and blade 51. At least one part of shaft 55 extends through an aperture 19 in exterior wall 11 of hopper 10 in cantilever fashion. Alternatively, an opposite end of shaft 55 can pass through exterior wall 11 of hopper 10 as shown in FIGS. 1 and 2. Aperture 19 is located on exterior wall 11 so that breaker assembly 50 is positioned near outlet 17 of hopper 10.

A bearing 57 allows shaft 55 to move relative to hopper 10. As described below, it is preferred that shaft 55 rotates in order to pivot blade 51 in a reciprocating manner. However, other types of movement are possible and could be used, if desired. For example, shaft 55 could translate in order to linearly move blade 51 parallel to outlet 17. In addition, shaft 55 could operate in a non-reciprocating manner. Likewise, a combination of the various movements of shaft 55 is also possible.

Figure 3:
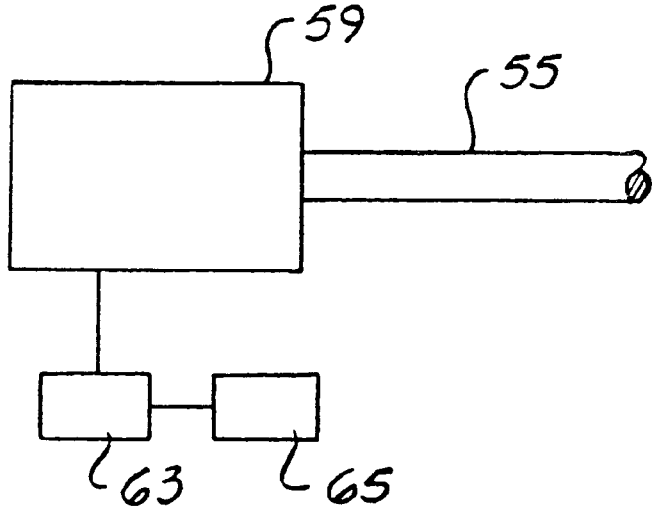
FIG. 3 is an elevational view of a motor and a shaft of the present invention.

FIG. 3 is an elevational view of a motor 59 that provides the necessary movement to shaft 55. As discussed above, motor 59 can provide rotation, translation, a combination of rotation and translation, or any other desired movement to shaft 55. Motor 59 is preferably electric, but other types of motors are also possible. Motor 59 does not have to be directly connected to shaft 55. Also, each shaft 55 could utilize a separate motor 59, or a single motor 59 could drive both shafts 55. A transmission, or gearing (not shown), can be used to provide the desired movement to shaft 55 from motor 59, or to provide a motive force to more than one shaft 55.

The preferred embodiment of the present invention utilizes two blades 51 that rotate in a reciprocating manner relative to hopper 10. In other words, blades 51 exhibit a shearing action therebetween. FIG. 1 shows blades 51 in a closed position. FIG. 2 shows blades 51 in a partially open position. Any clumps of particulate material (not shown) that travel down inner chamber 11 toward outlet 17 should be crushed or sheared by blades 51 into a size capable of exiting outlet 17 without interrupting the flow of particulate material (not shown). The crushing or shearing occurs either between the two blades 51, or between one blade 51 and exterior wall 11 of hopper 10.

Breaker assembly 50, in use, improves the flow of particulate material (not shown) from hopper 10 by preventing the clogging or bridging of outlet 17 of hopper 10. Breaker assembly 50 prevents a clog or bridge from approaching outlet 17 of hopper 10. Since the clog is distant from outlet 17, non-clumped particulate material (not shown) can still flow around the clumped material (not shown) and exit hopper 10.

Even when breaker assembly 50 is not operating or if a clog or bridge approaches outlet 17 within inner chamber 13, the flow of particulate material (not shown) should be unaffected. Particulate material (not shown) can flow past the clog or bridge between breaker assembly 50 and exterior wall 11 of hopper 10; and/or through breaker assembly 50. As seen in FIG. 1, breaker assembly 50 forms a conduit, or bypass, 61 between blades 51. Conduit 61 is formed since each blade 51 is L-shaped. When positioned adjacent each other, blades 51 form a square conduit 61. Particulate material (not shown) can enter bypass, or conduit, 61 from above breaker assembly 50; or through apertures 53 along blades 51. Clearly, it is seen that breaker assembly 50 allows particulate material (not shown) to flow through outlet 17 even when a clog or bridge forms in hopper 10. Breaker assembly 50 either breaks up the clog or bridge so that is passes through outlet 17; or prevents the clog or bridge from approaching outlet 17 to maintain the flow of particulate material (not shown) around the clog or bridge.

The present assembly also allows for the monitoring of the conditions within inner chamber 13 of hopper 10. Typically, when blade 51 encounters a clog or bridge, an increased input power load is generally required by motor 59 to break up the clog or bridge and/or to continue movement of blade 51. A monitoring unit 63 can detect an increased input power load to motor 59. In the preferred embodiment of an electric motor, monitoring unit 63 can be electrically connected to motor 59. When monitoring unit 63 detects an increased input power load, an alarm is signalled to indicate a possible blockage condition. An alarm 65 can signal a human operator that additional remedial measures may be required to remove the possible blockage. For example, the human operator user can initiate the aforementioned air blasts (not shown) in hopper 10 to assist in breaking up clogs or bridges. Applicants also recognize that monitoring unit 63 could also automatically initiate any additional remedial measure without the intervention of a human operator or without sounding an alarm.

Other types of monitoring units are also possible. The monitoring units do not have to be associated with the motor. For example, a monitoring unit (not shown) can sample the rotational speed of the shaft. When the rotational speed of the shaft falls below an expected value, a clog or bridge is possible. An alarm can be signalled upon this indication.

A monitoring unit (not shown) that measures the amount of torque on the system could also be utilized. When the monitor detects an increased loading, a clog or bridge is possible. An alarm can be signalled upon this indication.

Finally, a mass flow monitoring unit (not shown) could also be utilized. The monitor can compare the amount of mass flow through conduit 61 with the amount of mass flow between exterior walls 13 and conduit 61 (i.e. the remainder of the outlet). When the monitor detects a change in the amount of mass flow through conduit 61 relative to the amount of mass flow through the remainder of hopper 10, a clog or bridge is possible. An alarm can be signalled upon this indication.

Although described herein with reference to a preferred embodiment of a hopper, Applicants recognize that the present invention is not limited to such a specific use. For example, the present invention is capable of use in any dispenser of materials. In addition, the present invention is not limited to use only in high temperature processes, such as cement manufacturing.

It is also understood that many other variations are apparent to one of ordinary skill in the art from a reading of the above specification. Such variations are within the spirit and scope of the instant invention as defined by the following appended claims.

We claim:

1. A breaker assembly for use in a material dispenser having an inner chamber and an outlet therefrom, said breaker assembly comprising:

a plurality of blades located within the inner chamber;

said plurality of blades mounted on at least one pivotal shaft and movable between at least a first position and a second position, each of said plurality of blades having an L-shaped cross section;

in said first position at least one blade is adjacent at least one other of said blades;

in said second position at least one blade is away from at least one other of said blades;

said plurality of blades form a conduit therebetween, the conduit allowing the material to pass through the conduit; and a motor connected to said at least one blade for driving said at least one blade;

wherein the movement of said at least one blade prevents the material from clogging or bridging the outlet of the material dispenser.

2. The breaker assembly as recited in claim 1, wherein at least one of said plurality of blades includes at least one aperture therethrough for allowing the material to pass through said at least one aperture.

3. The breaker assembly as recited in claim 1, wherein said shaft connects said blade to said motor.

4. The breaker assembly as recited in claim 3, further comprising a sensor attached to one of said motor and said shaft for detecting at least one of an increased power load, a decreased speed and an increased torque loading in said breaker assembly.

5. The breaker assembly as recited in claim 3, wherein said motor drives said at least one shaft which in turn drives at least one of said plurality of blades in at least one of a rotational movement and a translational movement.

6. The breaker assembly as recited in claim 5, wherein said motor reciprocates said at least one shaft which in turn reciprocates said at least one blade.

7. The breaker assembly as recited in claim 1, further comprising a sensor connected to said motor for detecting an increased power load in said breaker assembly.

8. The breaker assembly as recited in claim 7, further comprising an alarm connected to said sensor;

wherein said sensor signals activates said alarm when said sensor detects the increased power load in said breaker assembly.

9. An apparatus for dispensing material, comprising:

a container having an exterior wall, an inner chamber, an inlet in communication with said inner chamber for receiving the material, and an outlet in communication with said inner chamber for dispensing the material;

a plurality of blades mounted on at least one shaft and disposed within said inner chamber;

a motor connected to at least one blade for movably driving said at least one blade; and a sensor attached to one of said motor and said at least one shaft for detecting at least one of an increased power load, decreased speed and an increased torque loading in said breaker assembly;

wherein the movement of said at least one blade prevents the material from clogging or bridging the outlet.

10. The apparatus for dispensing material as recited in claim 9, wherein said at least one blade is positioned adjacent said outlet of said container.

11. The apparatus for dispensing material as recited in claim 9, wherein said at least one blade includes at least one aperture therethrough for allowing the material to pass through said at least one aperture.

12. The apparatus for dispensing material as recited in claim 9, further comprising a shaft connecting said blade to said motor.

13. The apparatus for dispensing material as recited in claim 12, said exterior wall of said container further comprising at least one aperture therethrough; and wherein said shaft passes through said aperture of said exterior wall of said container.

14. The apparatus for dispensing material as recited in claim 9, wherein said motor drives said at least one shaft which in turn drives at least one of said plurality of blades in at least one of a rotational movement and a translational movement.

15. The apparatus for dispensing material as recited in claim 14, wherein said motor reciprocates said at least one shaft which in turn reciprocates at least one of said plurality of said blades.

16. The apparatus for dispensing material as recited in claim 9, further comprising a sensor connected to one of said motor, said at least one blade, and said hopper for detecting at least one of an increased power load and a change in mass flow in said apparatus.

17. The apparatus for dispensing material as recited in claim 16, further comprising an alarm connected to said sensor;

said sensor activates said alarm when said sensor detects one of the increased power load and the change in mass flow in said apparatus.

18. A method of dispensing material, said material being one of clumped material and unclumped material, comprising the steps of:

providing a container having an inner chamber, an inlet and an outlet;

providing a breaker assembly, said breaker assembly comprising:

a plurality of blades disposed within said inner chamber;

said plurality of blades mounted on at least one shaft and movable between at least a first position and a second position;

in said first position at least one blade is adjacent at least one other of said blades;

in said second position at least one blade is away from at least one other of said blades;

said plurality of blades form a conduit therebetween, in the first position, the conduit allowing the material to pass through said conduit; and a motor for driving said at least one blade;

supplying material to said inner chamber through said inlet of said container;

moving said at least one blade to reduce at least a portion of said clumped material into unclumped material; and dispensing the material from said outlet of said container.

19. The method of dispensing material as recited in claim 18, further comprising the step of detecting said clumped material.

20. The method of dispensing material as recited in claim 19, further comprising the step of signalling an alarm when said clumped material is detected.

21. The method of dispensing material as recited in claim 19, wherein the clumped material detecting step comprises the step of detecting at least one of an increased power load, a change in mass flow, a decreased rotational speed and an increased torque loading in said breaker assembly.

22. The method of dispensing material as recited in claim 18, wherein said breaker assembly operating step comprises at least one of rotating and translating said at least one blade.

23. The method of dispensing material as recited in claim 22, wherein said breaker assembly operating step further comprises the step of reciprocating said at least one blade.

* * * * *